US006484975B1

(12) United States Patent
Elrod et al.

(10) Patent No.: US 6,484,975 B1
(45) Date of Patent: Nov. 26, 2002

(54) METHOD AND APPARATUS TO ACHIEVE UNIFORM INK TEMPERATURES IN PRINTHEADS

(75) Inventors: Scott A. Elrod, La Honda, CA (US); Joy Roy, San Jose, CA (US); Richard G. Stearns, Santa Cruz, CA (US); John S. Fitch, Los Altos, CA (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/428,825

(22) Filed: Oct. 28, 1999

(51) Int. Cl.[7] ..... B41J 29/377
(52) U.S. Cl. ..... 247/18
(58) Field of Search ..... 347/10, 18, 20, 347/47, 48, 46

(56) References Cited

U.S. PATENT DOCUMENTS

| | | | | |
|---|---|---|---|---|
| 5,017,941 A | * | 5/1991 | Drake | 347/19 |
| 5,087,931 A | | 2/1992 | Rawson | 347/46 |
| 5,231,423 A | | 7/1993 | Wataya et al. | 347/18 |
| 5,333,007 A | * | 7/1994 | Kneezel et al. | 347/20 |
| 5,371,527 A | * | 12/1994 | Miller et al. | 346/46 |
| 5,622,897 A | | 4/1997 | Hayes | 438/21 |
| 6,134,291 A | | 10/2000 | Roy et al. | 377/46 |

FOREIGN PATENT DOCUMENTS

| | | |
|---|---|---|
| EP | 0 663 298 A1 | 4/1991 |
| EP | 0 736 390 A2 | 4/1996 |
| EP | 0 8174827 | 7/1996 |
| EP | 0 931 650 A1 | 7/1999 |
| EP | 1 008 451 A2 | 11/1999 |
| EP | 1 070 586 A2 | 1/2001 |
| EP | 1 008 451 A3 | 3/2001 |
| EP | 1 070 586 A3 | 3/2001 |

OTHER PUBLICATIONS

Patent Abstracts of Japan, vol. 1996, No. 11, Nov. 29, 1996.

* cited by examiner

*Primary Examiner*—Anh T. N. Vo
(74) *Attorney, Agent, or Firm*—Kent Chen

(57) ABSTRACT

A system for improving the uniformity of ink droplets delivered from a plurality of droplet sources on a printhead is described. The system includes a cooling system that compensates for nonuniform heating effects in a printhead which results in nonuniform temperatures. The distribution of the cooling system, and the effectiveness of the cooling system is set to maintain an approximately uniform ink temperature across the printhead.

22 Claims, 8 Drawing Sheets

FIG. 7
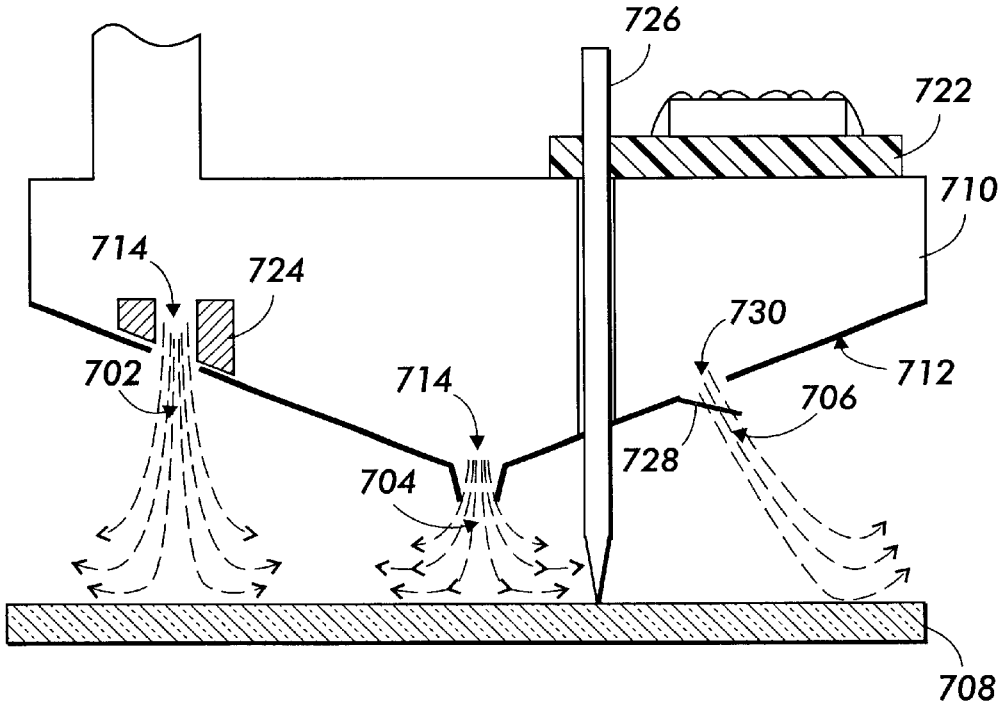
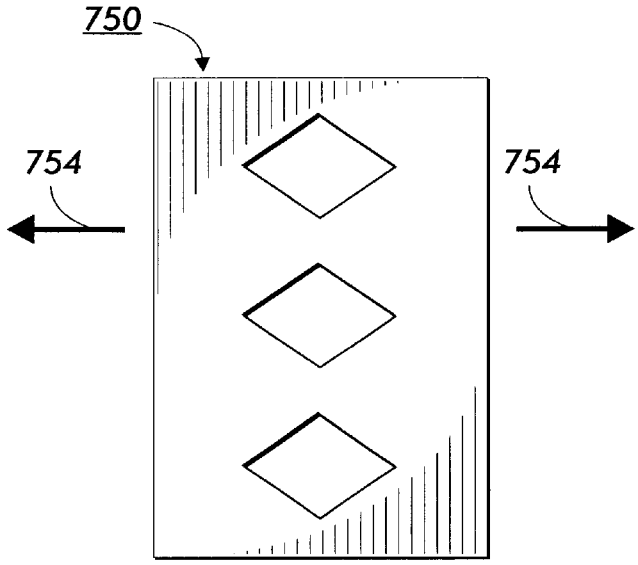
FIG. 8

METHOD AND APPARATUS TO ACHIEVE UNIFORM INK TEMPERATURES IN PRINTHEADS

FIELD OF THE INVENTION

The present invention relates to printing systems. More specifically, the present invention relates to a method of using spatially controlled cooling profiles to maintain uniform temperature of ink across the active zone of an acoustic ink printhead.

BACKGROUND

As computing products continue to drop in price while increasing in power, printing technology is driven by the need to reduce prices while improving printer resolution. One technology under development is acoustic ink printing (AIP). AIP focuses acoustic energy to eject droplets of a fluid from a free surface onto a recording medium. The fluid is typically ink, although in specialized applications, the fluid may be a molten solder, a hot melt wax, a color filter material, a resist, and various other chemical and biological compounds.

In AIP applications, a print head includes droplet sources that eject and deposit droplets on a receiving medium in a predetermined, controlled fashion. Each droplet sources includes a well containing ink and a transducer that agitates the ink and causes the ejection of droplets of ink from the well. A variety of manufacturing techniques, such as semiconductor processing techniques, may be used to form the transducer, the well, and the circuitry driving the transducer.

FIG. 9 illustrates a cross sectional view of a typical droplet source 90 shortly after ejection of a droplet 104 of marking fluid 108 and before a mound 112 on a free surface 116 of marking fluid 108 has relaxed. A radio frequency (RF) source 120 provides a RF drive energy of around 100 to 200 Megahertz (MHz) to a driver element such as a transducer 124 via bottom electrode 128 and top electrode 132. In one embodiment, the transducer is a piezoelectric transducer. The acoustic energy from the transducer passes through a base 136 into an acoustic lens 140. Acoustic lens 140 is often a Fresnel lens that focuses the received acoustic energy into a focused acoustic beam 138 which terminates in a small focal area near free surface 116. When sufficient acoustic energy is properly focused on free surface 116, a mound 112 is formed and a droplet 104 is ejected. A detailed description of a droplet source or "droplet ejector" is provided in U.S. Pat. No. 5,565,113 by Hadimioglu et al. entitled "Lithographically Defined Ejection Units" issued Oct. 15, 1996 and hereby incorporated by reference.

A typical print head, such as an AIP print head, includes arrays of droplet sources. Tight control of the droplet size and droplet velocity at each droplet source is important to obtain a high resolution accurate image. Variations in droplet size and/or velocity from droplet sources on the same printhead reduce the accuracy and uniformity of images created by the AIP system. Thus such variations should be minimized.

SUMMARY OF THE INVENTION

In order for an acoustic ink printer (AIP) to produce a high quality image, each droplet source on the AIP printhead should be designed to output droplets of uniform size and velocity. It has been found that as ink flows across the printhead from an ink supply or "source" to an ink outlet or "drain", the ink absorbs power from the many transducers distributed across a printhead. The absorbed power heats up the ink to produce an uneven temperature distribution in the ink. Uneven ink temperatures result in the output of nonuniform droplet sizes and velocities. In particular, warmer ink at droplet sources near the ink outlet results in the output of larger and higher velocity droplets compared to droplets output by droplet sources located across the printhead near the ink source. The warmer ink near the ink outlet results from energy transducer energy, both acoustic and thermal absorbed by the ink as it flows from the ink supply to the outlet. AIP printheads which are heated in order to eject phase change inks are particularly susceptible to these effects due the their relatively high viscosity (4–20 cp) resulting in high power dissipation compared to aqueous inks. The nonuniform droplet sizes and velocities degrade image quality.

In order to generate uniform droplet sizes and velocities from different droplet sources distributed across an AIP print head, a system to maintain the uniformity of ink temperature across the printhead is described. In one embodiment of the invention, a heat absorbing medium is placed on the opposite side of a substrate from the ink flowing across the printhead. The cooling effectiveness of the heat absorbing medium and the distance from the heat absorbing medium to the ink is adjusted to almost exactly compensate for the heating of the ink as it flows across the printhead such that the temperature difference in ink distributed across the print head is minimized. Alternative embodiments of the invention may adjust the flow of a cooling fluid across the backside of a printhead. As used in the following description, the backside of the printhead is a surface of the printhead upon which transducers are mounted. The heat characteristics and the flow of the cooling fluid are adjusted such that the ink temperature stays constant as the ink flows across the printhead.

BRIEF DESCRIPTION OF THE DRAWINGS

A more complete appreciation of the invention will be more readily obtained and understood by referring to the following detailed description and the accompanying drawings.

FIG. 7 illustrates the use of distributed airflow to maintain a constant temperature across the print head.

FIG. 8 illustrates a top view of vents that may be used to distribute an air flow.

DETAILED DESCRIPTION.

Figure 1:
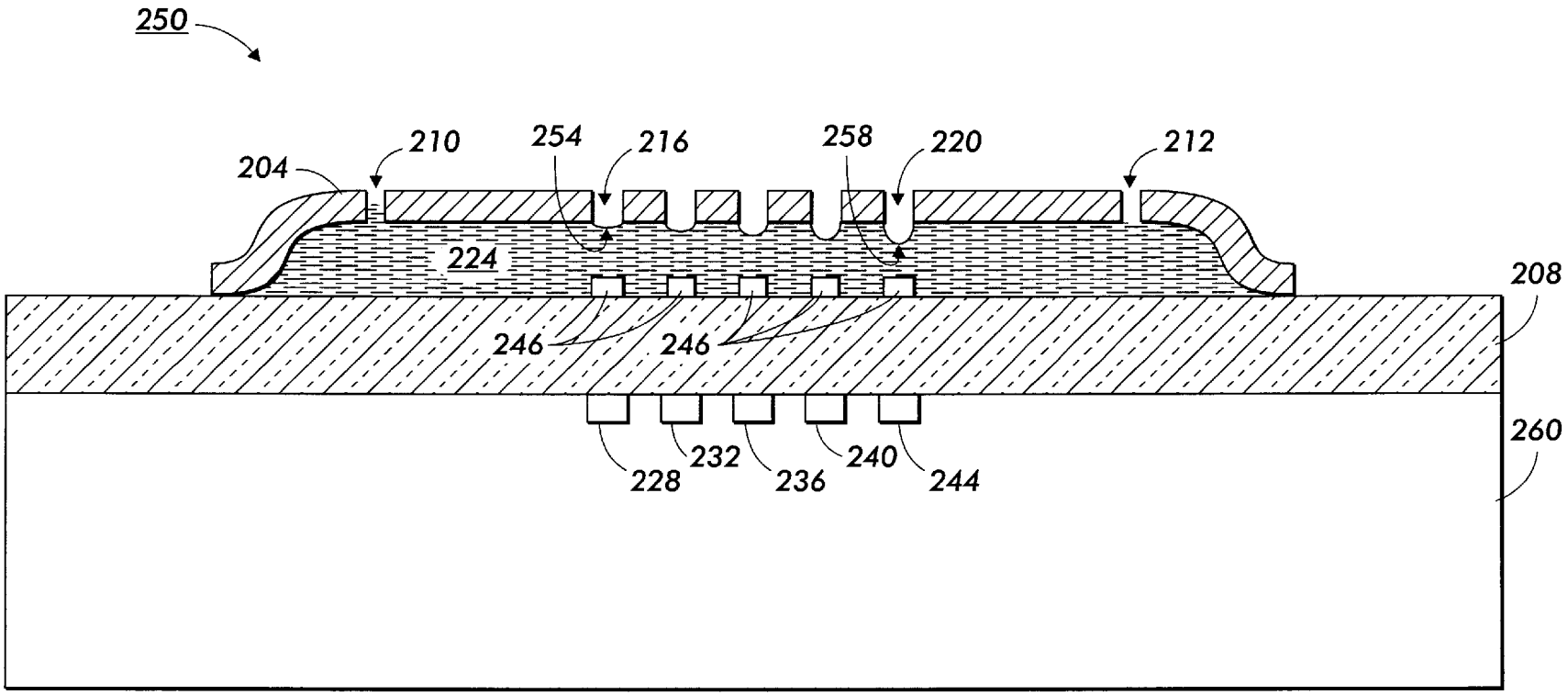
FIG. 1 illustrates a side view of one example of a print head.
Figure 2:
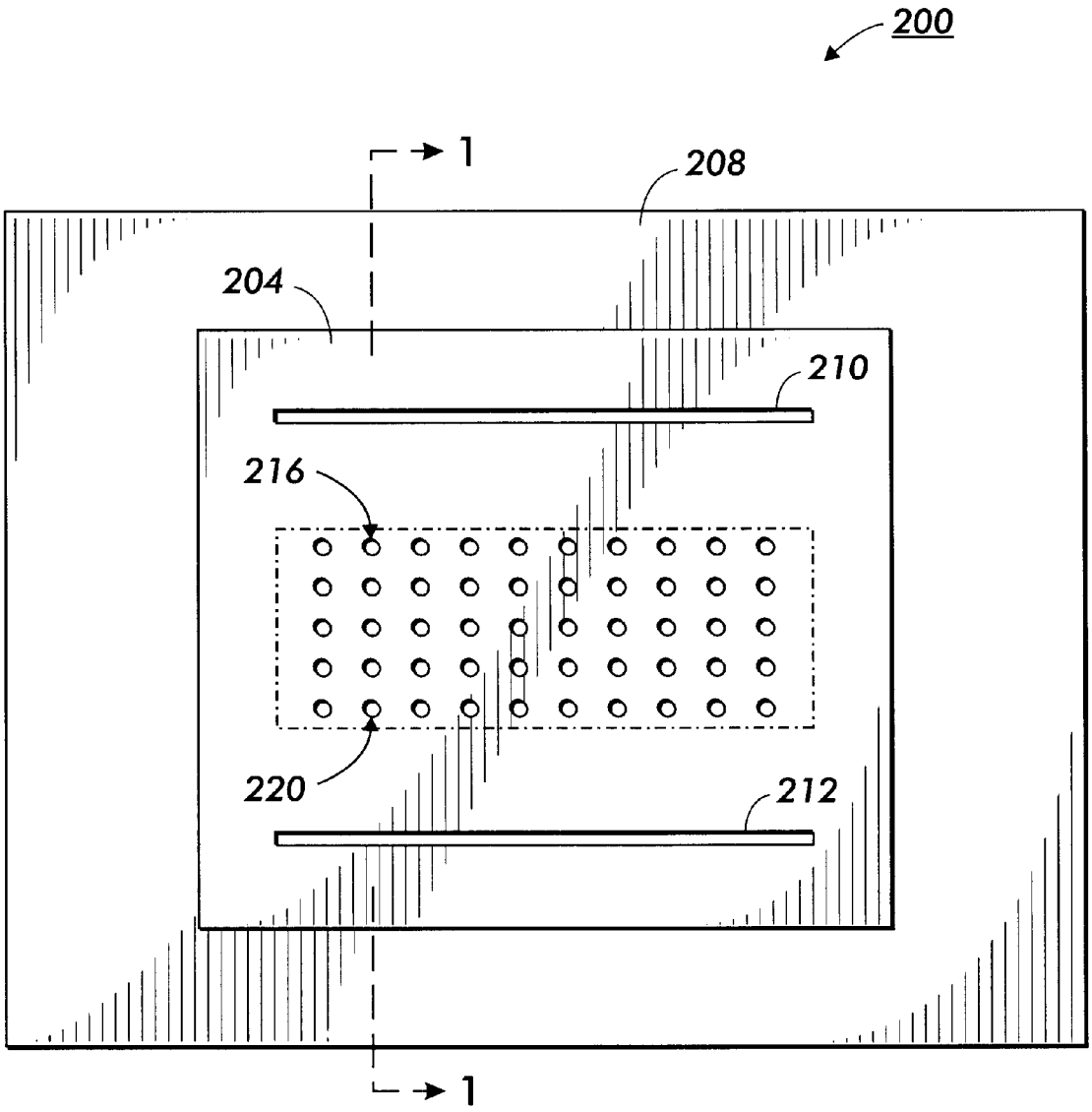
FIG. 2 illustrates a top view of one example of a print head.

FIG. 1 illustrates an underside view 200 and FIG. 2 is a side view 250 of a printhead. In the embodiment illustrated in FIG. 1, a metal plate 204 is mounted over a glass layer 208. A first slot 210 serves as an ink source. Ink flows from first slot 210 to a second slot 212 that serves as an ink outlet. The flow of ink from first slot 210 to second slot 212 is maintained by a pressure differential between the two slots. The velocity of the ink flow from first slot 210 to the second slot 212 is determined by the distance between plate 204 and glass 208, the pressure differential along the ink flow, and also by the properties of ink 224 such as viscosity.

As ink 224 propagates from an ink source such as first slot 210 to an ink outlet such as second slot 212, the printhead structure and ink undergoes heating from acoustic energy and RF losses (hereinafter collectively referred to as heating). The heating occurs in the transducers 228,232,236, 240, 244 and also through acoustic dissipation in the glass layer 208 and through the ink. Heating of the ink may also occur from thermal energy generated by the transducer itself through resistive or other inefficiencies. The thermal energy may also transfer through glass layer 208. If uncompensated, the heating effect results in warmer ink located near the ink outlet and cooler ink near the ink source.

When using low viscosity aqueous inks, the temperature differentials may be minimized by maintaining a high ink velocity between the ink source and the ink outlet. However, when more viscous fluids, such as phase change inks are used, such a high velocity cannot be maintained. Attempts to increase the ink velocity by increasing the pressure difference between the ink source and the ink outlet results in unacceptable differences in meniscus position 254, 258 at droplet sources 216, 220 as illustrated in FIG. 1. Meniscus 254 is the free surface of the ink at aperture 216. The meniscus shape is determined by the pressure in the ink and air, and the properties of the ink, air and plate 208. Large differences in meniscus adversely affect the uniformity of droplets output from droplet source 216, 220.

In order to maintain a consistent meniscus size and ink velocity for a phase change ink, the average pressure of ink 224 is kept approximately 3 torr below atmospheric pressure. The actual pressure ranges from approximately 1.7 torr below atmospheric pressure near the droplet source 216 closest to the source of ink to a pressure of approximately 4.3 torr below atmospheric pressure at the droplet source 220 closest to the ink outlet. The flow rate of a typical phase change ink is approximately 18–35 milliliters per minute per inch of printhead length. Cooling apparatus 260 described further below minimizes temperature differences in ink 224.

Figure 3:
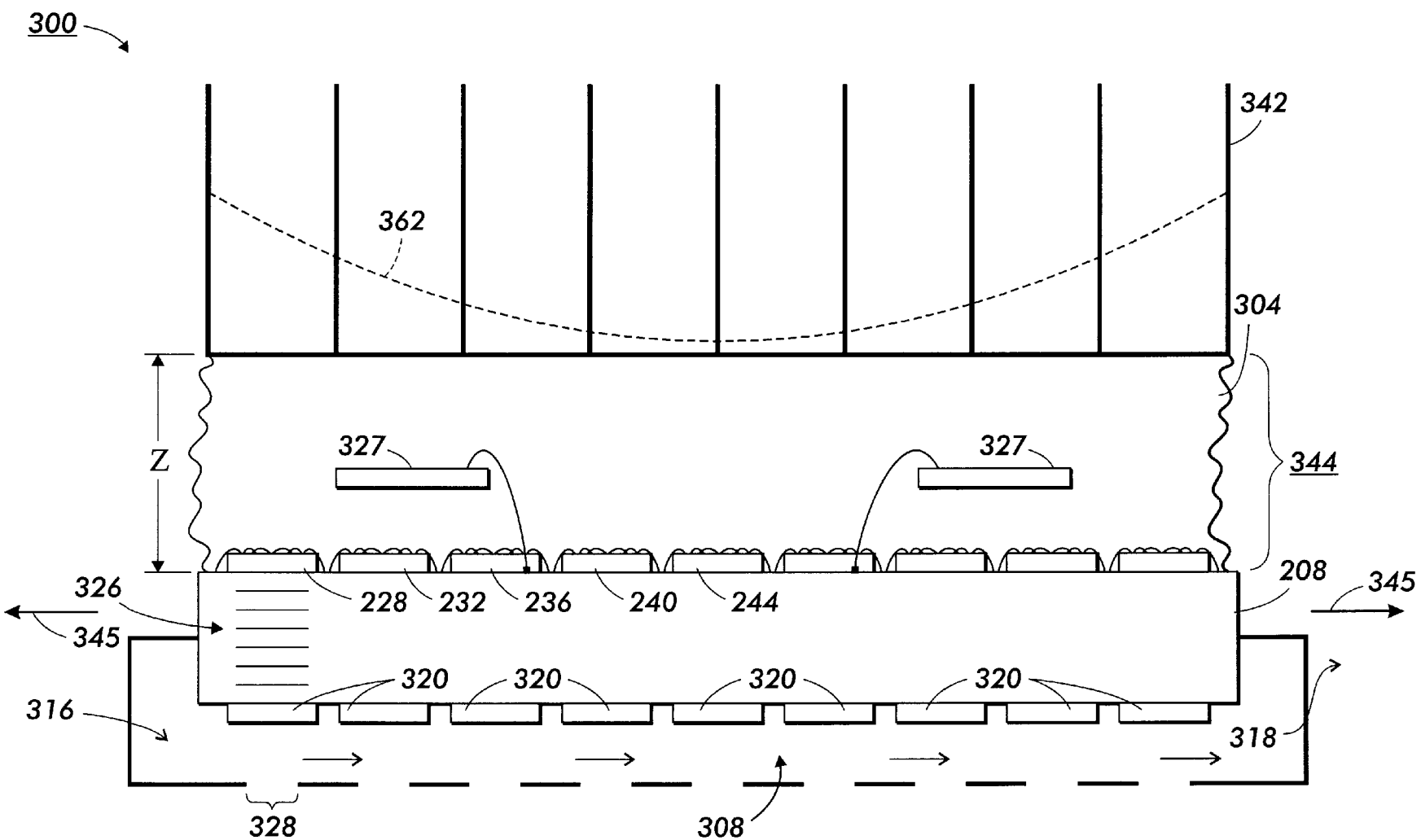
FIG. 3 illustrates a cross sectional view of a system that uses a variable thickness elastomer to keep the temperature of ink flowing across an AIP printhead constant.

FIG. 3 illustrates a printhead 300 that uses a heat sink 342 as one embodiment of the aforementioned cooling apparatus. Printhead 300 includes a variable thickness elastomer 304 coupled to heatsink 342 to keep ink 308 across glass layer 208 at a constant temperature. The ink 308 flows from an ink source 316 at a first end of printhead 300 to an ink outlet 318 positioned at a second end of printhead 300.

A series of Fresnel lenses 320 are deposited and patterned on a glass substrate such as glass layer 208. The Fresnel lenses receive energy from corresponding transducers 228, 232,236,240, 244 also mounted to glass layer 208. A bridge 327 includes wires that couple the transducer array to driving electronics (not shown).

When driving electronics determine that a droplet is to be ejected, the driving electronics cause a corresponding transducer to vibrate. Each vibrating transducer such as transducer 228 generates waves 326 that propagate through glass layer 208. A Fresnel lens 320 focuses the waves. The waves focus to a point and eject a droplet of ink from the ink surface within an aperture such as aperture 328. Some fraction of the acoustic energy is absorbed by ink 308. The absorbed energy heats the ink.

In one embodiment of the invention, the ink is a phase change ink. Heating effects are particularly troublesome in phase change inks because the low maximum flowrates of approximately 18–35 milliliters/minute per inch of printhead length across the glass 312 does not allow quick removal of heated ink. The low flowrates are due to the high viscosity (4–20 cp) and low surface tension (20–30 dyne/cm) of phase change inks. The high viscosity also results in higher wave attenuation and thus higher power absorption of acoustic energy. Higher power absorption increases ink heating. The combination of increased ink heating and lower flowrates makes the invention particularly useful when phase change inks are used in a printhead, although it should be noted that the invention is also applicable to aqueous inks as well as other materials to be deposited that change properties such as viscosity according to temperature.

When a heat sink is used, elastomer 304 thermally couples glass layer 208 to a heat sink 342. The elastomer is typically an electric insulator and thus provides a protective passivation coating for wirebonds and transducers. One example of such an elastomer is Slygard 165 manufactured by Dow Corning Corp. The thickness of the elastomer is expressed as a "z" parameter 344. The thickness or "z" determines the effective cooling parameter $h_{eff}$ of the combination heat sink 342 and elastomer 304. To a first order, the cooling parameter $h_{eff}$ is proportional to the thermal conductivity "K" of the elastomer divided by the thickness Z of the elastomer.

By adjusting the thickness of the elastomer, the cooling effectiveness of the combination heat sink 342 and elastomer is set to compensate for heating across the printhead. If heat loss from the active region of the printhead to the environment is uniform, and if transducers across the printhead evenly heat the ink, then the ideal z parameter is a constant. However, most printheads lose heat in a lateral direction indicated by arrows 345. These natural thermal losses from the edge of the printhead reduce the amount of cooling needed near the edge of glass layer 208. To reduce the cooling parameter $h_{eff}$ near the edge of glass layer 208, the z parameter is increased near the edge of glass layer 208 to produce a convex heat sink bottom. An appropriate z profile is illustrated by dotted line 362. A more detailed discussion of cooling parameter heff will be provided with the discussion associated with FIG. 5.

Figure 4:
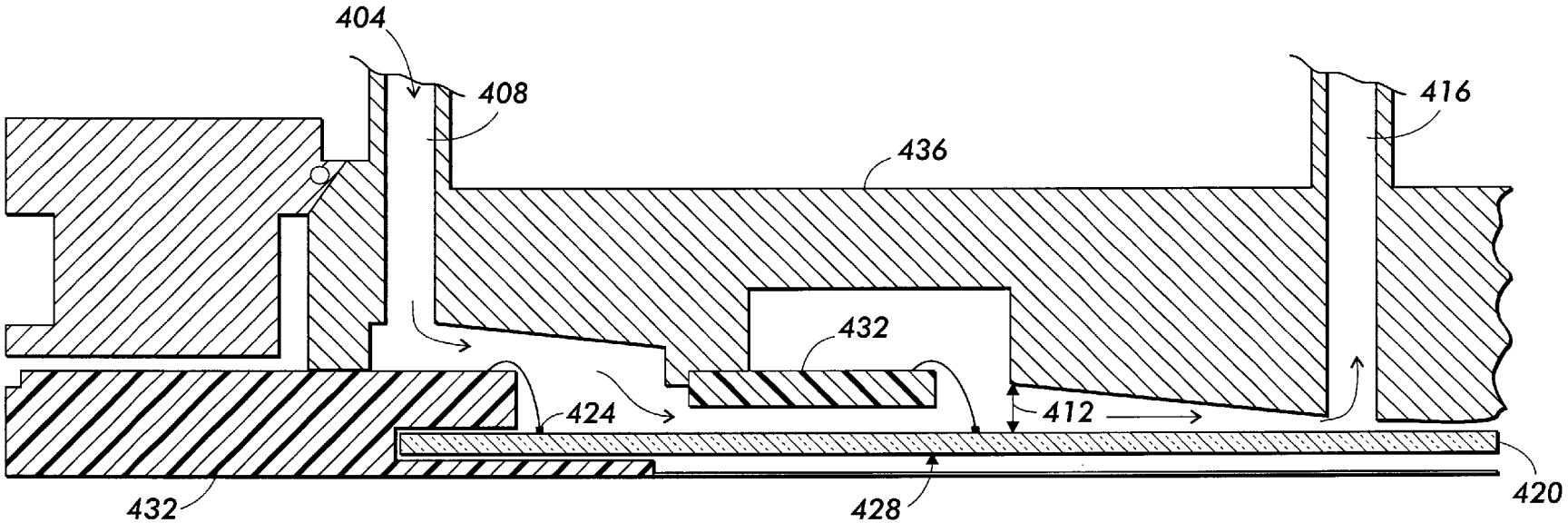
FIG. 4 illustrates a cross sectional view of a system that uses a variable width channel carrying a cooling fluid to keep constant the temperature of ink flowing across an AIP printhead.

FIG. 4 illustrates an embodiment of the invention that uses a fluid coolant instead of a heat sink to maintain a constant ink temperature across an AIP printhead. As used herein, a fluid may be either a liquid or a gas. In FIG. 4, fluid coolant 404 enters coolant input 408 and flows along a coolant conduit or channel 412 before exiting the printhead through coolant outlet 416. In the illustrated embodiment, one side of coolant channel 412 forms a backside of glass layer 420, the same surface upon which transducers 424 are mounted. Ink flows across an opposite or ink droplet side 428 of glass layer 420.

Backside electronics, including bridge 432, may be distributed along the path of fluid flow. As previously indicated, bridge 432 typically includes wires and bond pads that couple transducers 424 to control electronics. To avoid electrical problems, the selected coolant is an inert material that will not attack the backside electronics and transducers. An example of such a coolant is Fluorinert manufactured by 3M Corporation of St. Paul, Minn.

As a fluid coolant passes over a warmer surface, the fluid coolant cools that surface in proportion to the temperature difference between the warmer surface and the cooler fluid coolant. As that temperature difference decreases, the cooling potential is reduced. Other parameters being held constant, the cooling effectiveness is proportional to the cooling potential. Near coolant input 408, the coolant has a maximum cooling potential. However, as the coolant flows along channel 412, a warm boundary layer grows from warm solid surfaces. Near coolant output 416, the coolant is warmest and the cooling potential is at a minimum.

In order to compensate for the decrease in coolant potential due to coolant heating and an increased boundary layer, the coolant velocity is increased as it passes through channel 412. An increase in coolant velocity is achieved by narrowing the cross sectional area of coolant channel 412. Increasing the coolant velocity increases the coolant's heat transfer coefficient, $h_{eff}$. The rate at which coolant channel 412 narrows is selected such that the increase in velocity of the coolant offsets the increased temperature of the coolant and boundary layer build up to maintain an approximately uniform cooling of surfaces, thereby yielding an approximately isothermal surface across a backside of the printhead. A more detailed coolant channel profile will be discussed with reference to FIG. 6.

Figure 5:
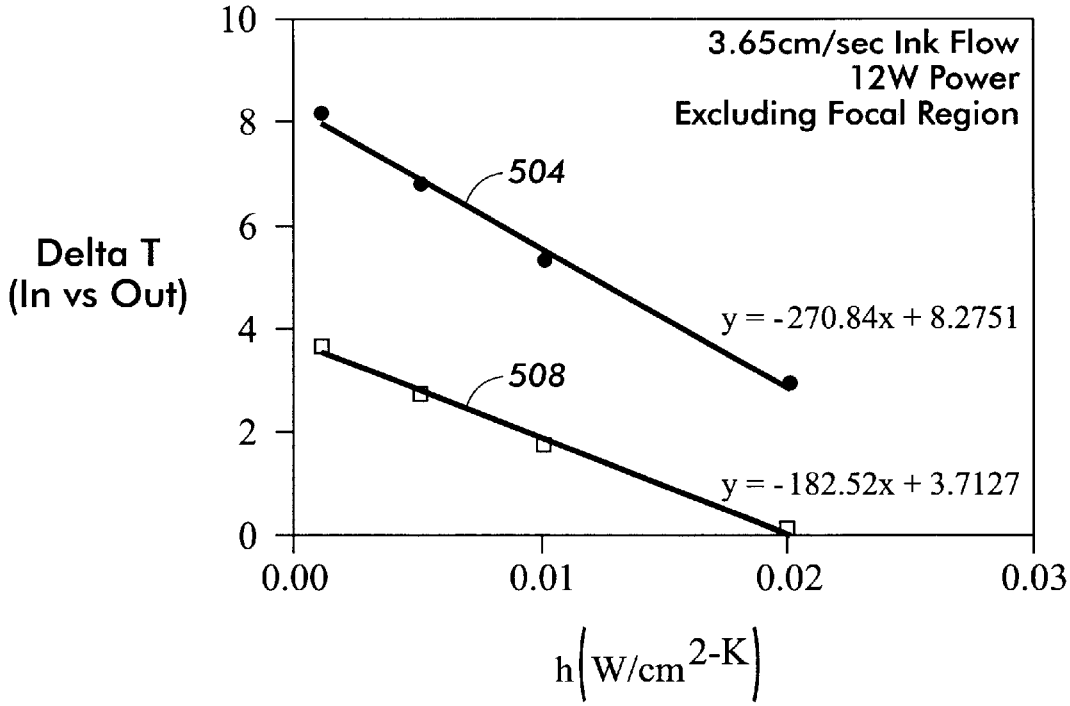
FIG. 5 is a graph of the maximum ink temperature differential across a printhead as a function of different cooling constants applied to a backside of the printhead.

FIG. 5 is a graph that illustrates the temperature difference (delta T) of the ink between the ink source and the ink outlet as a function of a cooling coefficient, ($h_{eff}$ in watts per square centimeter per degree Kelvin), applied to a backside of the printhead. Curve 504 graphs the difference in the average temperature between the inlet and the outlet of the active ejector zone. The average temperature is the integrated average of temperature through the ink layer. Curve 508 graphs the temperature difference for the surface of the ink flow near meniscus position 254, 258. The curves provided in FIG. 5 are illustrative, the actual curves may vary depending on a number of factors including the temperature of the ink, the rate of ink flow, and the dissipation of power in the ink flow. In the illustrated example, the ink temperature is approximately 150 degrees centigrade, the power dissipated is approximately 12 watts, and the ink flow velocity is approximately 3.65 cm/sec.

In order to achieve uniform droplet output from the printhead, ideally, the ink temperature difference across the printhead should be as close to zero as possible. In the example of FIG. 5. curve 504 reaches zero temperature difference when $h_{eff}$ is about 0.03 W/cm$^2$-K while curve 508 reaches a zero temperature difference when $h_{eff}$ is around 0.02 W/cm$^2$-K. Thus a desired value for cooling constant heff under the particular conditions described is between 0.02 and 0.03 W/cm$^2$-K.

Figure 6:
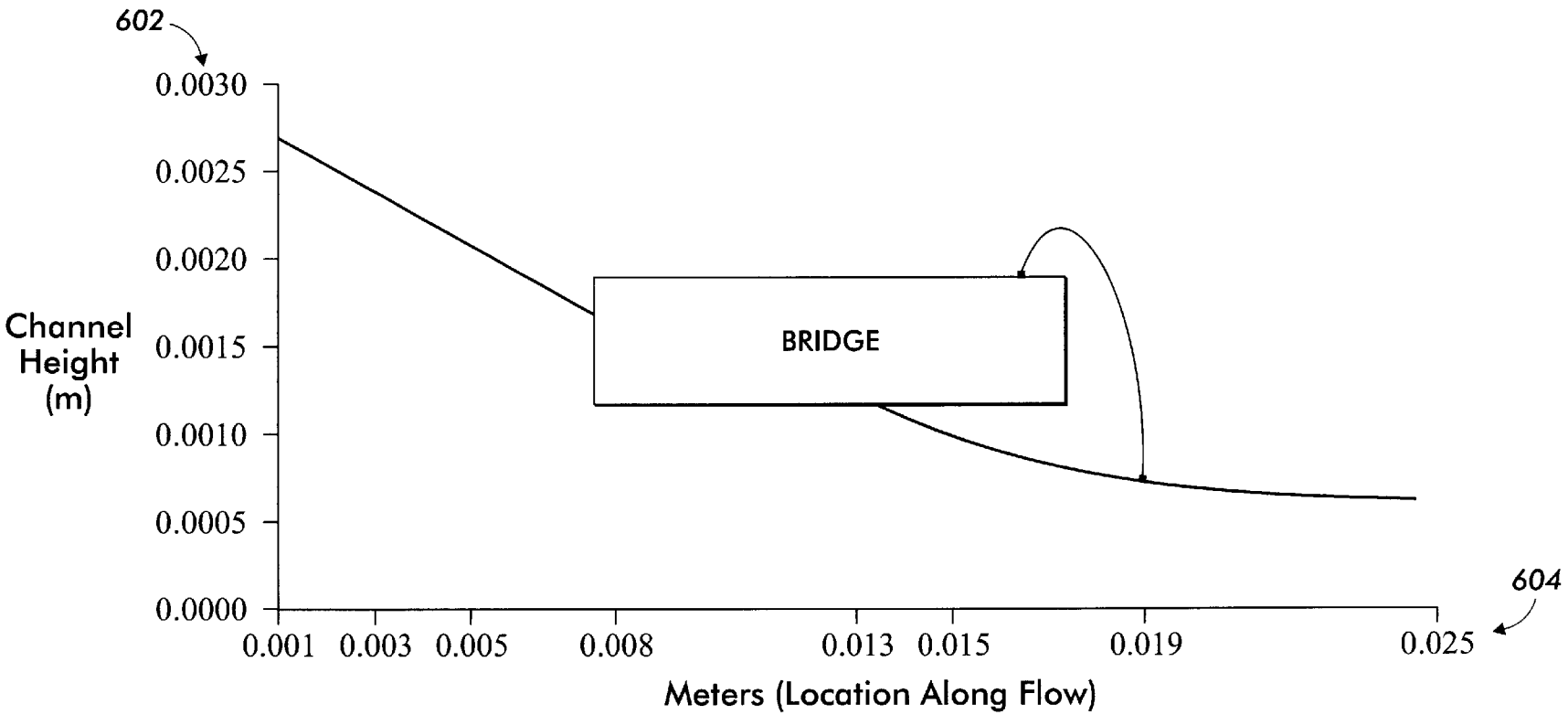
FIG. 6 illustrates a typical channel profile for the system of FIG. 3 to achieve a particular temperature across a printhead.
Figure 9:
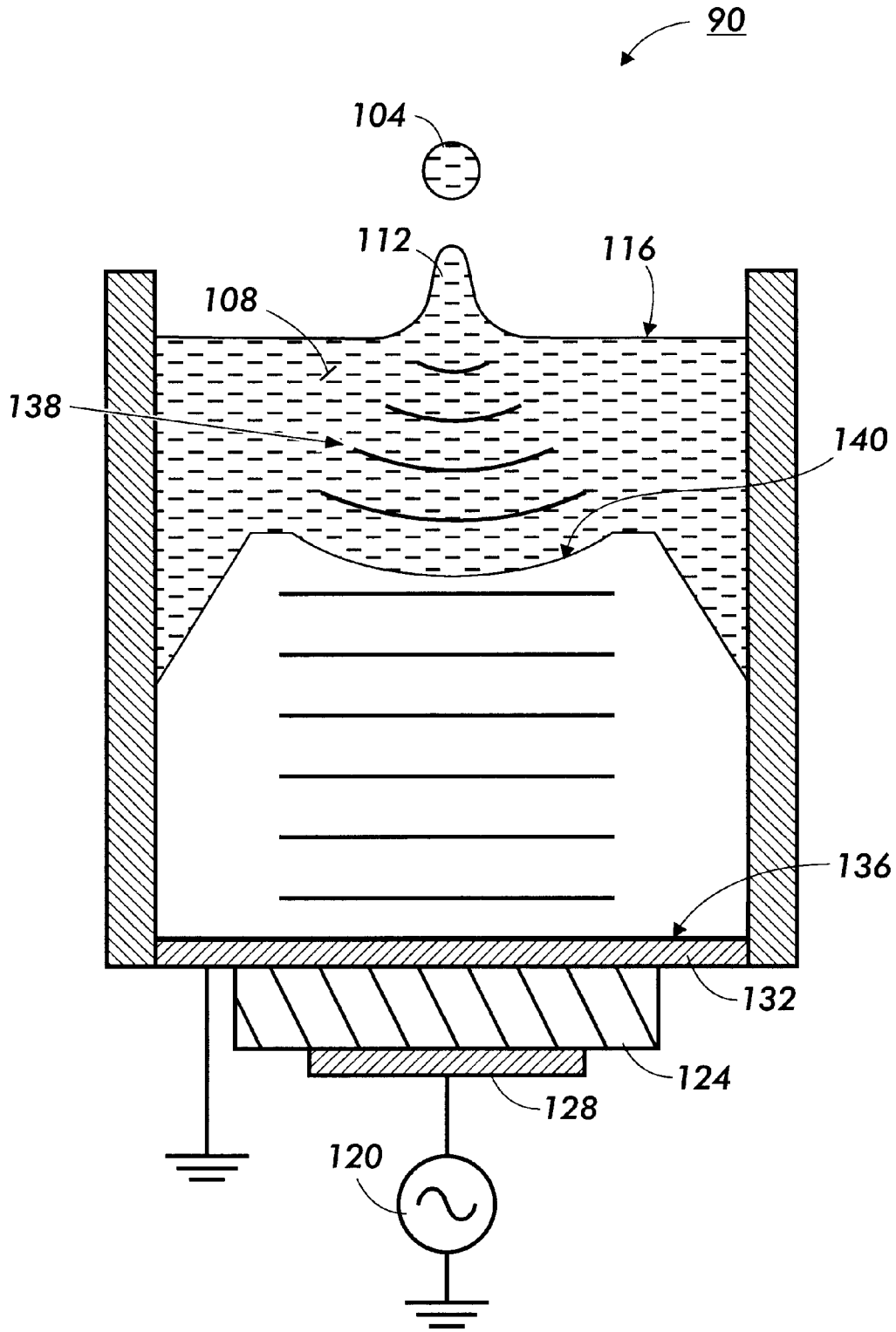
FIG. 9 illustrates a cross section view of an acoustic drop ejector that is shown ejecting a droplet of marking fluid, according to the prior art.

FIG. 6 shows an example of a detailed channel profile for one embodiment of the fluid cooling system of FIG. 4. Channel height "z" in meters is plotted along vertical axis 602 of FIG. 6. Horizontal axis 604 indicates the distance from the entrance point of the cooling fluid. In the illustrated example, the shape of the channel alters the flow velocity, and therefore h, such that the resulting surface temperature is constant. In this example, the resulting wall temperature is 168 degrees centigrade and the highest coolant velocity is approximately 60 cm/sec. The illustration of FIG. 6 is for a particular set of specifications and is provided as an example only. Changes in the parameters will change the channel profile.

FIG. 7 and FIG. 8 show an alternate system of cooling the backplane of a printhead. In FIG. 7, jets of fluid, typically air, are used to maintain a constant temperature across the printhead. The system of jets 702, 704, 706 distributes fluid, typically a cooling gas such as helium or a liquid, across the backside of a printhead 708. The jets exit chamber 710 through openings in an orifice plate 712. In the illustrated embodiment, the orifice plate includes nozzles or apertures 714 that allow air to exit chamber 710 in a small number of discrete jets. In an alternate embodiment, the orifice plate may consist of a porous material to allow a diffuse flow of air. Examples of appropriate porous materials include Cordiorite from Corning or sintered metal.

The pattern of jets from chamber 710 may be varied across the orifice plate to account for variations in cooling fluid pressures and temperatures. In the illustrated embodiment, the orifice plate directs jets, such as airjet 706, to arrive at a non-normal incident angle to the printhead backplane. Non-normal incidence increases the cooling effectiveness of the air stream.

Typically, a cooling system is designed to compensate for an average or a median rate of droplet output. However, printing a dark image may increase the number of droplets needed resulting in a localized increase in transducer activity and a corresponding increase in localized heating. To compensate for the increased heating, cooling efficiencies may need to be increased.

In one implementation of the invention, chamber 710 may serve as a package or housing for support electronics, such as electronics 722. As shown, electronics 722 may include the driver electronics for the transducers of the AIP printhead. Pogo pin 726 illustrates one method of coupling electronics 722 to the transducers.

One method of determining when increased cooling efficiencies are needed is to monitor transducer activity. To detect increased transducer activity, one embodiment of the invention includes components 724 that receives or monitors the data stream in a print signal. The print signal communicates the number of transducers that will be fired. The number of transducers fired is used to determine how much cooling is needed. When high numbers of transducers are fired, components 724 may increase airflows or adjust nozzles to fulfill the additional cooling requirements. In an alternate embodiment, the data stream is used to forecast transducer activity before the transducer activity actually occurs. The coolant flow can then be adjusted in anticipation of the increased transducer activity.

In one embodiment, components 724 may be a microelectromechanical valve near the orifice that opens wider to increase coolant flow when the print signal indicates that more transducers will be firing. In an alternate embodiment, component 424 may be a heater that locally adjusts the coolant temperature. In a third example, component 424 is a non-electrical component, such as a bimetallic strip or shape memory alloy that reacts to temperature.

FIG. 7 shows one possible positioning of a bimetal strip 728 in close proximity to an orifice 730. Bimetal strip 728 absorbs radiant heat from printhead 708 and accordingly changes shape or dimensions. The changes alter the opening size of orifice 730 to change the flow of coolant from orifice 730. In an alternate embodiment, bimetal strip 728 may be replaced with a temperature sensor and a feedback system that determines the amount of cooling needed and accordingly adjusts the coolant fluid flow.

Although the preceding description describes the jets as being transferred or "pushed" from chamber 710, in an alternate embodiment, the air could be "pulled" into chamber 710. Pulling air into chamber 710 creates a different cooling effectiveness because fluid velocities and temperatures behave differently when the fluid is pulled or sucked instead of pushed or blown.

Different air vent patterns may also be used to change air flow. For example, in FIG. 8, air vent pattern 750 is designed to recognize that lateral cooling of the printhead along the direction of arrows 754 decreases cooling requirements along a perimeter of the printhead. Accordingly, wider opening of the vents at the center of air vent pattern 750 provides increased airflow at the center and decreased airflow along the perimeter of the printhead.

Although the preceding discussion has been used to describe cooling a printhead, the above described cooling systems may also be used to heat the ink. Heating of the ink may be accomplished by altering the relative temperature of the cooling fluid and the ink such that the cooling fluid or the heat sink is warmer than the ink. Heating the ink may be particularly useful during printhead warm up/start up.

While the invention has been described in terms of a number of specific embodiments, it will be evident to those skilled in the art that many alternatives, modifications, and variations are within the scope of the teachings contained herein. For example, variations in parameters, such as the cooling coefficient may fluctuate depending on the rate of ink flow, the viscosity of the ink, the temperature of the ink and the type of ink used. The described printhead is also useful for ejecting materials other than ink. Accordingly, the present invention should not be limited by the embodiments used to exemplify it, but rather should be considered to be within the spirit and scope of the following claims, and equivalents thereto, including all such alternatives, modifications, and variations.

What is claimed is:

1. A printhead system comprising:

a plurality of transducers distributed across a printhead, the transducers to deliver energy to ink flowing across a surface of the printhead; and a cooling system with a cooling effectiveness coupled to the printhead, the cooling system including a coolant flow over a second surface of the printhead and a detection system to detect a local temperature, the cooling system to locally adjust a flow of coolant in response to changes in the local temperature, the cooling effectiveness of the cooling system distributed across the printhead to approximately compensate for heating that results from the energy delivered by the transducers such that a temperature of the ink across the printhead is approximately constant.

2. The printhead system of claim 1 wherein printhead is an acoustic-ink printhead that generates ink droplets using acoustic energy from the transducers.

3. The printhead system of claim 1 wherein the cooling effectiveness is between 0.01 and 0.07 watts per square centimeter per degree Kelvin.

4. The printhead system of claim 1 wherein the ink is a phase change ink that is a solid at a room temperature of thirty degrees centigrade.

5. The printhead system of claim 1 wherein ink flows across the surface due to capillarity.

6. The printhead system of claim 1 wherein an ink flowrate is less than 40 milliliters per minute per inch of printhead length.

7. The printhead system of claim 1 wherein the cooling system comprises:

a heat sink; and an elastomer that thermally couples a backside of the printhead to the heat sink.

8. The printhead system of claim 7 wherein the elastomer thickness is varied.

9. The printhead system of claim 8 wherein the elastomer is thinnest at a center of the printhead.

10. The printhead system of claim 1 wherein the cooling system comprises:

a coolant channel coupled to a second surface of the printhead, the coolant channel having different cross sectional areas at different positions along the printhead, the different cross sectional areas to adjust the cooling effectiveness at the different positions.

11. The printhead system of claim 1 wherein the cooling system comprises:

a channel that carries a cooling fluid from a source of the cooling fluid to a drain of the cooling fluid, the channel to have a first cross sectional area near the source and a second cross sectional area near the drain, the first cross sectional area larger than the second cross sectional area.

12. The printhead system of claim 1 wherein the cooling system comprises:

a source of air positioned to distribute multiple streams of air over a backside of the printhead.

13. A printhead system comprising:

a plurality of transducers distributed across a printhead, the transducers to deliver energy to ink flowing across a surface of the printhead; and a cooling system with a cooling effectiveness coupled to the printhead, the cooling system including a coolant flow over a second surface of the printhead; and a detection system to predict future transducer activity, the detection system to adjust the coolant flow in anticipation of the future transducer activity, the cooling effectiveness of the cooling system distributed across the printhead to approximately compensate for heating that results from the energy delivered by the transducers such that a temperature of the ink -across the printhead is approximately constant.

14. A method of improving a printhead output comprising the operations of:

inputting ink into the printhead at a first temperature;

delivering energy to the ink at a first transducer to form a droplet of ink, excess energy absorbed by the ink causing a rise in temperature of the ink to a second temperature in the proximity of the first transducer; and using a cooling system to cool the ink back to the first temperature while the ink flows from the first transducer to a second transducer, the cooling system to direct a cooling fluid flow over a surface of the printhead, a temperature of the cooling fluid adjusted to maintain an approximately constant cooling effectiveness.

15. The method of claim 14 further comprising:

delivering acoustic energy from the second transducer to form a second droplet of ink, energy from the second transducer absorbed by the ink across the printhead to cause the ink across the printhead to rise to a third temperature in the proximity of the second transducer.

16. The method of claim 15 further comprising:

cooling the ink from the third temperature back to the first temperature while the ink flows from the second transducer to a third transducer.

17. The method of claim 14 further comprising:

heating the ink at an ink source to the first temperature prior to the operation of delivering energy to the first transducer, the heating process converting the ink from a solid to a liquid.

18. The method of claim 14 wherein the cooling operation further comprises:

transferring heat from a backside of the printhead through a thermal conducting medium to a heatsink.

19. The method of claim 14 wherein the cooling operation further comprises:

directing a cooling fluid flow over the backside of the printhead, a velocity of the cooling fluid adjusted to maintain an approximately constant cooling effectiveness.

20. The method of claim 14 wherein the cooling operation further comprises:

directing multiple airflows over a second surface of the printhead.

21. The method of claim 14 wherein the cooling apparatus used for the cooling operation has a cooling effectiveness between 0.01 and 0.07 Watts per square centimeter per degree Kelvin.

22. The method of claim 14 wherein the flowrate of the ink is less than 40 milliliters per minute per inch of printhead length.

* * * * *